US006082422A

United States Patent [19]

Kaminski

[11] Patent Number: 6,082,422

[45] Date of Patent: Jul. 4, 2000

[54] MONEY CLIP AND CARD HOLDER

[75] Inventor: Scott T. Kaminski, San Ramon, Calif.

[73] Assignee: Storus Corp., San Ramon, Calif.

[21] Appl. No.: 09/087,658

[22] Filed: May 30, 1998

Related U.S. Application Data

[60] Provisional application No. 60/047,188, Jun. 3, 1997.

[51] Int. Cl.[7] ..... A45C 11/18

[52] U.S. Cl. ..... 150/147; 150/137; 206/38; 206/39

[58] Field of Search ..... 150/137, 147; 206/37, 39, 38; D11/78.1; 24/336

[56] References Cited

U.S. PATENT DOCUMENTS

| | | | |
|---|---|---|---|
| D. 184,679 | 3/1959 | Kraemer | D11/78.1 |
| D. 330,688 | 11/1992 | Haines | D11/78.1 X |
| 685,333 | 10/1901 | Hunter | 206/37 |
| 1,377,379 | 5/1921 | Williams | 206/39 X |
| 1,766,599 | 6/1930 | Cahill | 150/137 X |
| 1,851,013 | 3/1932 | Michaud et al. | D11/78.1 X |
| 2,666,545 | 8/1954 | Fontana | 150/137 |
| 3,100,494 | 8/1963 | Littman | D11/78.1 X |
| 3,454,069 | 7/1969 | Machler | 150/137 |
| 3,596,757 | 8/1971 | Cocchiaraley | 150/137 X |
| 4,518,080 | 5/1985 | Ohlson | 206/37 X |
| 5,077,869 | 1/1992 | Haase . | |
| 5,520,230 | 5/1996 | Sumner, III | 150/137 X |
| 5,653,276 | 8/1997 | Niernberger | 150/137 |

FOREIGN PATENT DOCUMENTS

| | | | |
|---|---|---|---|
| 630535 | 12/1927 | France | 206/39 |
| 274969 | 8/1927 | United Kingdom | 206/39 |

*Primary Examiner*—Sue A. Weaver
*Attorney, Agent, or Firm*—George W. Wasson

[57] ABSTRACT

The combination money clip and card holder comprises a one-piece element having a rectangular base with two inwardly-oriented L-shaped brackets formed along longitudinal edges thereof. The rectangular base also contains a stop, formed on one of the transverse edges thereof. Together with the rectangular base, the L-shaped brackets comprise a channel for receiving flexible cards, such as credit cards, whereas the stop prevents the cards from being inserted too far into the channel. The edges of the base supporting the L-shaped brackets are tapered in the direction of the stop to provide means for removably capturing the cards inserted into the channel. The holder also includes a resilient money clip formed on the opposite side of the base. The money clip is formed so that it is biased toward the base, thus allowing bank notes inserted between the clip and the base to be removably retained therein.

15 Claims, 4 Drawing Sheets

MONEY CLIP AND CARD HOLDER

CROSS-REFERENCE TO RELATED APPLICATIONS

This application claims the benefit of U.S. Provisional Application No. 60/047,188, filed Jun. 3, 1997.

STATEMENT REGARDING FEDERALLY-SPONSORED RESEARCH OR DEVELOPMENT

Not Applicable

REFERENCE TO MICROFICHE APPENDIX

Not Applicable

BACKGROUND OF THE INVENTION

This invention relates to a device for holding paper currency and cards such as business cards and conventional credit cards. More particularly, the invention relates to a combination money clip and card holder adapted to retain paper currency as well as removably store flexible cards, e.g., credit cards, and sized to be conveniently carried in a pocket or purse.

Prior-art holders for paper currency and cards are disclosed in U.S. Pat. Nos. 5,358,019 and 5,520,230 to Sumner, Ill. Each of these holders has features that permit paper currency to be clipped to the holder on one side thereof and cards to be inserted in a channel formed on the other side thereof. However, the above-mentioned holders lack the ability to secure cards in a convenient manner and their construction leads to increased manufacturing expense.

BRIEF SUMMARY OF THE INVENTION

It is accordingly desirable to provide a combination money clip and card holder that is inexpensive to construct and that includes means for removably retaining paper currency and cards therein.

It is also desirable to provide a holder having positive retaining means for cards inserted into the holder.

Furthermore, it is desirable to provide a holder that may be constructed of formable and bendable metal as well as from injection molded plastic materials that have strength and form memory.

Further advantages of the invention will become apparent from consideration of the ensuing description and the accompanying drawings.

In one embodiment of the invention, the combination money clip and card holder comprises a one-piece element having a rectangular base with two inwardly-oriented L-shaped brackets formed along longitudinal edges thereof. The rectangular base also contains a stop, formed on one of the transverse edges thereof. Together with the rectangular base, the L-shaped brackets comprise a channel for receiving flexible cards, such as credit cards, whereas the stop prevents the cards from being inserted too far into the channel. The edges of the base supporting the L-shaped brackets are tapered in the direction of the stop to provide means for removably capturing the cards inserted into the channel. The holder also includes a resilient money clip formed on the opposite side of the base. The money clip is formed so that it is biased toward the base, thus allowing bank notes inserted between the clip and the base to be removably retained therein.

BRIEF DESCRIPTION OF THE SEVERAL VIEWS OF THE DRAWING

The present invention is illustrated by way of example, and not by way of limitation, in the figures of the accompanying drawings, where.

DETAILED DESCRIPTION OF THE INVENTION

Throughout the following description, specific details are set forth in order to provide a more thorough understanding of the invention. However, the invention may be practiced without these particulars. In other instances, well-known elements have not been shown or described to avoid unnecessarily obscuring the present invention. Accordingly, the specification and drawings are to be regarded in an illustrative, rather than a restrictive, sense.

Figure 1:
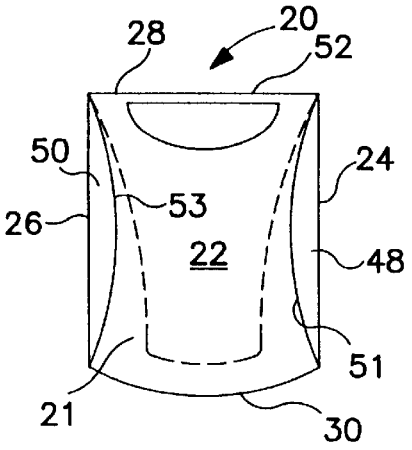
FIG. 1 is a front elevation view of the holder.
Figure 5:
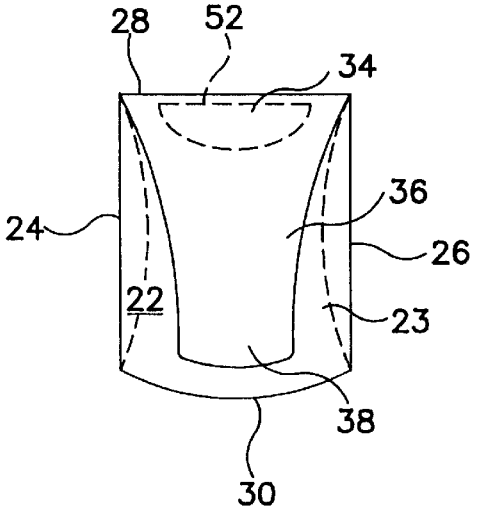
FIG. 5 is a back elevation view of the holder of FIG. 1.
Figure 6:
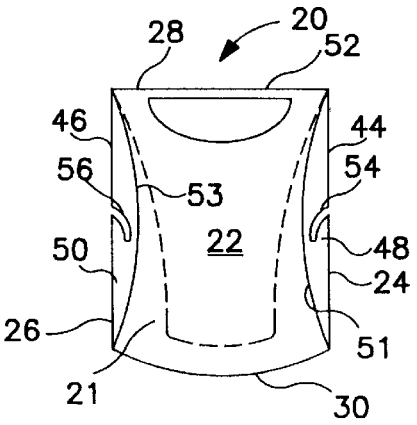
FIG. 6 is a front elevation view of an alternative form of the holder.
Figure 10:
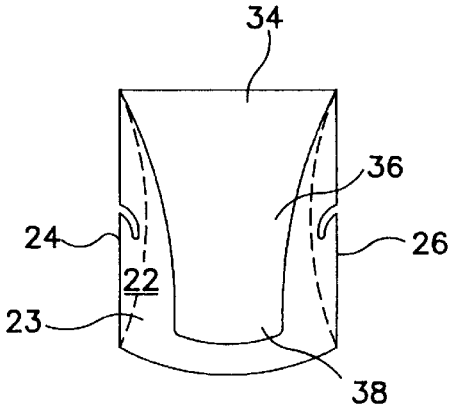
FIG. 10 is a back elevation view of the holder of FIG. 6.

FIGS. 1 and 6 illustrate two embodiments of combination money clip and card holder 20 of the present invention. Both embodiments share a flat base 22 having a substantially rectangular shape defined by longitudinal edges 24, 26 and transverse edges 28, 30. Base 22 defines a first substantially-flat surface 21 (FIGS. 1 and 6) and a second substantially-flat surface 23 (FIGS. 5 and 10). Extending from edge 28 along surface 23 is a resilient money clip 32 (FIGS. 3, 5, 8, and 10), integrally formed with base 22. Money clip 32 has a curved proximal end 34, substantially-flat midsection 36, and a bowed distal end 38. Proximal end 34 is formed so as to bias clip 32 toward surface 23, whereby foldable paper currency (not shown) can be secured between distal end 38 and surface 23.

Figure 4:
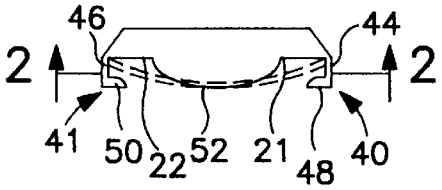
FIG. 4 is a top plan view of the holder of FIG. 1.
Figure 9:
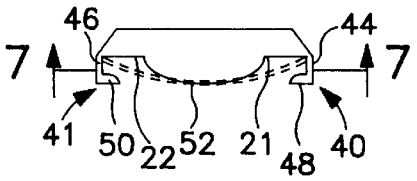
FIG. 9 is a top plan view of the holder of FIG. 6.

As depicted in FIGS. 4 and 9, retaining members 40 and 41, formed integrally with base 22 and comprising brackets having L-shaped cross-sections, are disposed along longitudinal edges 24 and 26, respectively, and extend over surface 21. Members 40 and 41 include substantially rectangular portions 44 and 46, respectively, disposed perpendicular to base 22, as well as portions 48 and 50, respectively, disposed parallel to base 22. Portions 48 and 50 have curved edges 51 and 53, respectively. Retaining members 40 and 41, together with surface 21 of base 22 comprise the card-retaining channel of the present invention. A stop 52, perpendicular to surface 21, is formed integrally with base 22 along transverse edge 28 to prevent flexible cards, e.g., credit cards (not shown) from being inserted too far into the channel.

Figure 2:
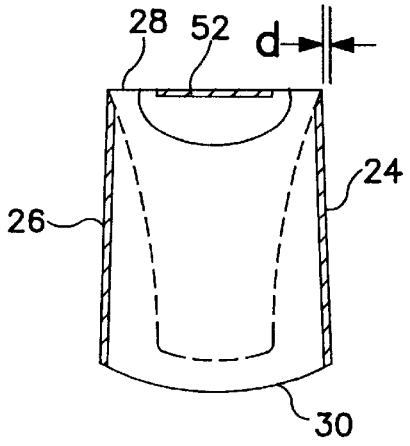
FIG. 2 is a sectional view of the holder taken along the lines 2—2 of FIG. 4.
Figure 3:
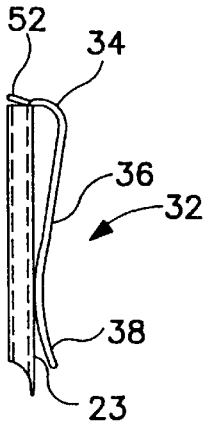
FIG. 3 is a side elevation view of the holder of FIG. 1.
Figure 7:
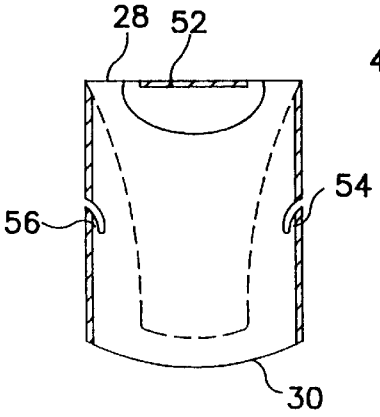
FIG. 7 is a sectional view of the holder taken along the lines 7—7 of FIG. 9.
Figure 8:
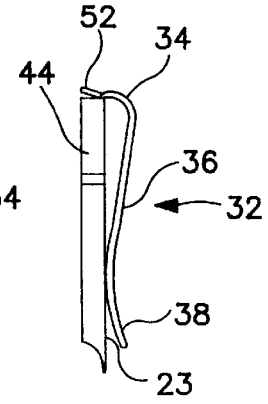
FIG. 8 is a side elevation view of the holder of FIG. 6.

Two different embodiments of the present invention addressing various methods of removably securing flexible cards inside the retaining channel are shown in the drawings. FIG. 2 illustrates, in exaggerated proportions, a taper in the alignment of the two edges 24 and 26 of the retaining channel and FIGS. 6, 7, and 8 show formations along the channel for engaging and cooperating with cards inserted into the channel. In FIG. 2, a distance "d" is shown to illustrate a taper of the channel from the input end at edge 30 to the end at edge 28, bounded by stop 52. The transverse dimension of the channel at edge 30 is designed to accommodate the insertion of a plastic or paper card and is slightly larger (by the distance "d") than the transverse dimension at the edge 28, thus creating a slight taper in the channel. With this taper a card inserted into the channel is slightly flexed, as illustrated by phantom lines in FIGS. 4 and 9, whereby the card is retained within the channel.

Figure 10A:
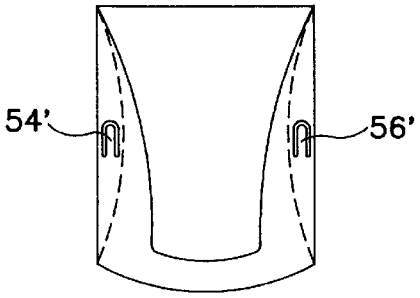
FIG. 10A is a back elevation view of the holder of FIG. 6 having card-retaining means disposed in an alternative location.

A similar retaining force is accomplished by the mechanism illustrated in FIGS. 6, 7, and 8 where lateral cantilever spring elements 54 and 56, comprising resilient fingers, are formed along members 40 and 41, respectively. The cantilever springs function to engage a plastic card inserted into the channel by urging that card to flex. Similar functions can be accomplished by forming cantilever springs 54' and 56' in base 22 (FIG. 10A) or sections 48 and 50 of the retaining members. As has been described above, cards inserted into the channel are stopped at the fully-inserted position by engagement of the cards with stop 52.

Figure 11:
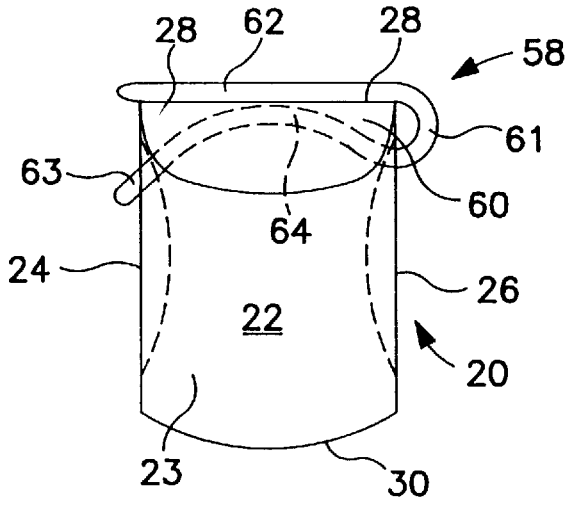
FIG. 11 is a back elevation view illustrating an alternative form of the holder having a spring clip.
Figure 11A:
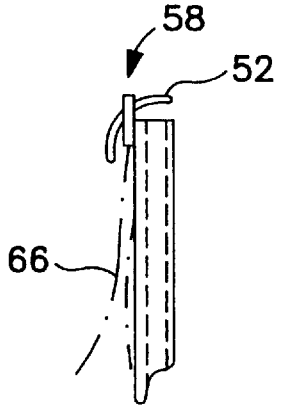
FIG. 11A is a side elevation view of the holder of FIG. 11.
Figure 11B:
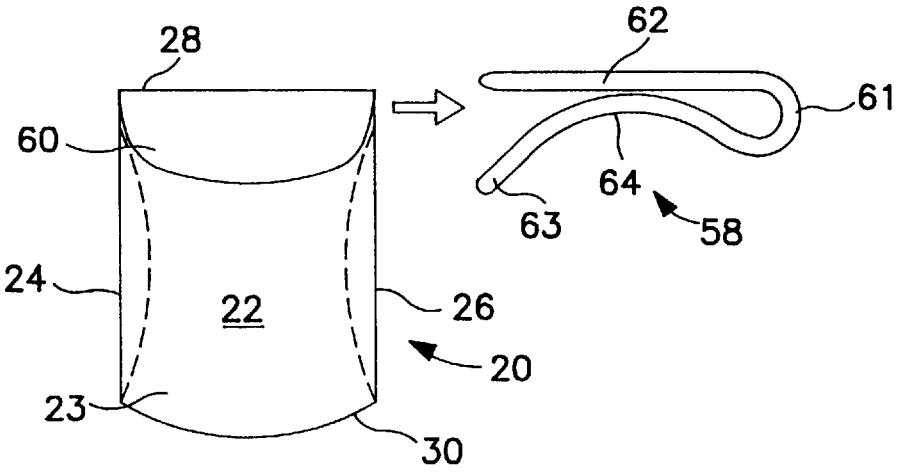
FIG. 11B illustrates the holder of FIG. 11 with the spring clip removed.

FIGS. 11 and 11A illustrate yet another embodiment of the holder of the present invention wherein a spring clip 58 is biased to engage a curved supporting section 60, integrally formed with base 22. Clip 58 includes an outer segment 62, an inner segment 64, a loop segment 61, and a tongue 63. As shown in FIG. 11A, clip 58 is adapted to secure foldable paper currency within the holder by frictionally capturing bank notes 66 between its inner portion 64 and the interior of curved section 60. In this embodiment of the invention bank notes 66 may be attached to holder 20 by placing the folded portion of the bank notes over tongue 63 and pulling the bank notes toward loop segment 61 of the clip. As illustrated in FIG. 11B, clip 58 may be detached from curved section 60.

Figure 12:
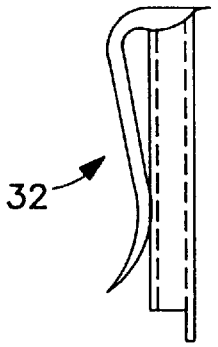
FIG. 12 is a side elevation view of a form of the invention with the channel and money clip on the same side of the holder.

As shown in FIGS. 1 through 11A, the holder of the present invention is adapted for the insertion of flexible cards and foldable paper currency from the same end of the holder. However, the design of the holder may be changed so that flexible cards and paper currency are inserted from opposite ends, as shown in FIG. 12.

Figure 13:
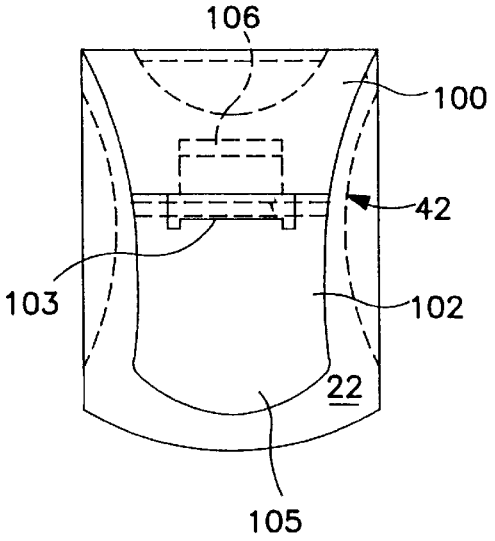
FIG. 13 is a front elevation view of the holder having a money clip with over-center action.
Figure 13A:
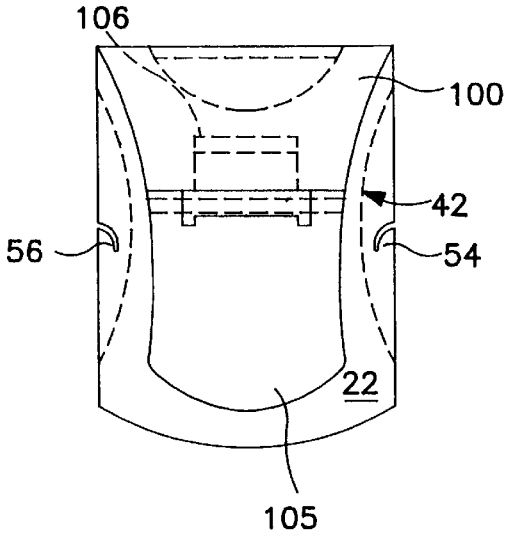
FIG. 13A illustrates an alternative form of the holder of FIG. 13.
Figure 14:
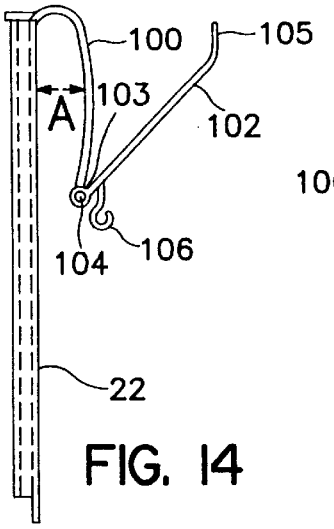
FIG. 14 is a side elevation view of the holder of FIG. 13 with the money clip in an open position.
Figure 15:
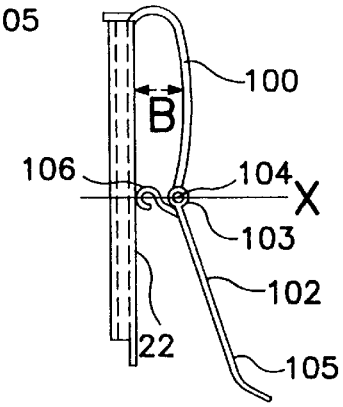
FIG. 15 is a side elevation view of the holder of FIG. 13 with the money clip in a partially-closed position.
Figure 16:
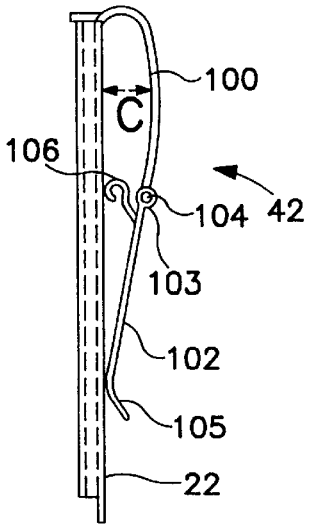
FIG. 16 is a side elevation view of the holder of FIG. 13 with the money clip in a closed position.

Another embodiment of combination money clip and card holder is illustrated in FIGS. 13, 14, and 16. Money clip 42 includes a resilient portion 100, integrally formed with base 22, and a lever portion 102, whose proximal end 103 is hinged to resilient portion 100 by means of a pivot pin 104. Lever portion 102 further includes a distal end 105 which is curved to facilitate manual manipulation of portion 102. A tang 106 is formed integrally with lever portion 102 and provides over-center action that deflects resilient portion 100 away from base 22 when lever portion 102 is pivoted toward base 22. As shown in FIG. 14, when lever portion 102 is pivoted away from base 22, no contact exists between tang 106 and base 22, whereby resilient portion 100 defines an angle A with respect to base 22. When, as illustrated in FIG. 15, lever portion 102 is partially pivoted toward base 22 so that tang 106 and pin 104 are positioned along a line X perpendicular to base 22, tang 106 pushes against base 22 to deflect resilient portion 100 away from base 22 such that an angle B is defined between resilient portion 100 and base 22. As apparent from FIG. 16, pivoting lever portion 102 toward base 22, until distal end 105 of lever portion 102 rests on base 22, deflects resilient portion 100 away from base 22 at an angle C, which is greater than angle A but is less than angle B. This deflection of resilient portion 100 presses tang 106 into base 22, increasing the coefficient of friction therebetween, which allows paper currency (not shown) to be securely retained between tang 106 and base 22. The coefficient of friction between tang 106 and base 22 is sufficient for clip 42 to secure even a single bank note (not shown), but the friction is not large enough to prevent bank notes from being pulled out by hand if desired. To insert bank notes into clip 42, distal end 105 may be used to pivot lever portion 102 away from base 22 so that tang 106 no longer presses against base 22. The bank notes (not shown) are then positioned between resilient portion 100 and base 22. To secure bank notes within money clip 42, lever portion 102 is pivoted toward base 22 until distal end 105 contacts base 22, whereby bank notes are captured between tang 106 and base 22. FIG. 13A illustrates the holder of FIG. 13 having cantilever spring elements (resilent fingers) 54 and 56.

Holder 20 may be formed of resilient metal and can be formed from a sheet of such material with the members 40 and 42 defining the channel for retaining flexible cards, stop 52, and money clip 32 folded from the sheet to form the holder. Cantilever springs 54 and 56 along the channel can also be formed as the holder is pressed from sheet and the taper of the channel can be formed as the pressed sheet stock is folded. The holder may also be manufactured using plastic material that has a reasonable rigidity and memory; such materials can be injection molded to form the holder as a complete unit.

Figure 18:
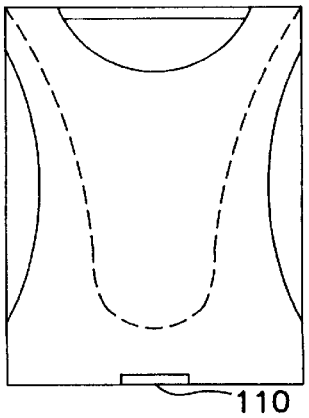
FIG. 18 is a front elevation view of the holder where the flexible cards are retained by means of two stops.
Figure 17:
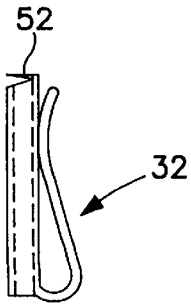
FIG. 17 is a side elevation view of the holder where the paper currency and the flexible cards are inserted in opposite directions.

It should also be understood that the holder can be formed with the money clip and the card channel on the same side of the holder in which case retaining members 40 and 42 defining the channel would be formed toward the money clip side and the function of the stop would be accomplished by curved portion 34 of the money clip, as shown in FIG. 18. Also, the cards may be retained in the holder by means of a second stop 110 disposed opposite to stop 52, as shown in FIG. 18.

The above configurations of the combination money clip and card holder are given only as examples. Therefore, the scope of the invention should be determined not by the specific illustrations given, but by the appended claims and their equivalents.

What is claimed is:

1. A one-piece holder for securely and simultaneously retaining both flexible, foldable paper currency and bendable cards, said one-piece holder comprising:

a) a longitudinally extending base having a first substantially planar surface and a second, opposed substantially planar surface, two opposed longitudinally extending side edges and two transversely extending end edges, said two end edges extending between respective ends of said longitudinally extending side edges, b) a resilient retaining member integrally formed with said base, said resilient retaining member extending from one of said two transversely extending end edges over said first substantially planar surface, said resilient retaining member being biased toward said first substantially planar surface, c) two substantially rigid retaining members integrally formed with said base, said two substantially rigid retaining members each including a first portion extending from said second, opposed substantially planar surface, defining a plane extending substantially perpendicular to said second, opposed substantially planar surface, and a second portion extending from said first portion, defining a plane extending substantially perpendicular to said first portion and extending substantially parallel to said second, opposed substantially planar surface, d) said second portion of said substantially rigid retaining members terminating in continuously curved edges extending over said second, opposed substantially planar surface, e) said two substantially rigid retaining members defining a retaining channel between said second, opposed planar surface and said two substantially rigid members for receipt of at least one bendable card therebetween, f) a stop formed perpendicular to said base and extending toward said retaining members and into said retaining channel at said end edge where said resilient retaining member is formed.

2. The holder of claim 1 wherein said retaining channel formed by said two substantially rigid retaining members has a smaller transverse dimension at said end edge where said stop is formed than the transverse dimension at the open end of said retaining channel.

3. The holder of claim 1 with means formed in said retaining channel of said retaining members for engaging a bendable card when inserted into said retaining channel to removably wedge said card in said retaining channel.

4. The holder of claim 3 wherein said formed means are resilient fingers on said first portion of said retaining member to wedge said bendable cards into said holder.

5. The holder of claim 3 wherein said means are resilient fingers formed from the base of said holder to force said cards up into said channel.

6. The holder of claim 3 wherein said means formed in said retaining channel is formed from the second portion to force said cards down into said channel.

7. The holder of claim 1 wherein said retaining channel and said resilient retaining member are on the same side of the longitudinally extending base.

8. The holder of claim 1 wherein said resilient retaining member and said stop originate at the opposite edges of said longitudinally-extending base.

9. A combination money clip and card holder, comprising:

a base having a substantially rectangular shape, a first and a second surface, two longitudinal edges, and two transverse edges;

brackets having L-shaped crossections and formed integrally with said base along said two longitudinal edges, the brackets and said first surface defining a channel;

a stop formed integrally with said base on said first surface along one of said two transverse edges; and a hinged clip extending from one of said two transverse edges over said second surface and including a resilient portion integrally formed with said base and a lever portion pivotally attached to said resilient portion, said lever portion including means for deflecting said resilient portion away from said second surface and capturing articles between said hinged clip and said base.

10. The money clip and holder of claim 9 wherein said two longitudinal edges of said base are tapered so that the width of said channel is greatest along the transverse edge opposite the transverse edge having said stop.

11. The money clip and holder of claim 9 wherein the brackets contain resilient members biased inwardly with respect to said channel.

12. A combination money clip and card holder, comprising:

a base having a substantially rectangular shape, a first and a second surface, two longitudinal edges, and two transverse edges;

brackets formed integrally with said base along said two longitudinal edges, the brackets and said first surface defining a channel;

a stop formed integrally with said base on said first surface along one of said two transverse edges;

combination means for removably capturing paper currency, said means disposed along said second surface;

and wherein said combination means includes a supporting portion extending from one of said two transverse edges.

13. The money clip and card holder of claim 12 wherein said supporting portion is rigid.

14. The money clip and card holder of claim 12 wherein said means for removably capturing paper currency further includes a removable spring clip extending across said supporting portion, said spring clip being biased to engage said supporting portion, said spring clip having a first section disposed along the exterior of said supporting portion and a second section disposed along the interior of said supporting portion for removably capturing paper currency by frictionally engaging the currency against the interior of said supporting portion.

15. The money clip and card holder of claim 12 further including a second stop disposed on the transverse edge opposite to said first stop.

* * * * *

US006082422C1

(12) EX PARTE REEXAMINATION CERTIFICATE (7146th)

United States Patent

Kaminski

(10) Number: US 6,082,422 C1

(45) Certificate Issued: Nov. 10, 2009

(54) MONEY CLIP AND CARD HOLDER

(76) Inventor: Scott T. Kaminski, Storus Corp., 12919 Alcosta Blvd. St. 1, San Ramon, CA (US) 94583-1340

Reexamination Request:
No. 90/009,043, Feb. 15, 2008

Reexamination Certificate for:

| | |
|---|---|
| Patent No.: | **6,082,422** |
| Issued: | **Jul. 4, 2000** |
| Appl. No.: | **09/087,658** |
| Filed: | **May 30, 1998** |

Related U.S. Application Data

(60) Provisional application No. 60/047,188, filed on Jun. 3, 1997.

(51) Int. Cl.
*A45C 11/18* (2006.01)

(52) U.S. Cl. ..... 150/147; 150/137; 206/38; 206/39

(58) Field of Classification Search ..... None
See application file for complete search history.

(56) References Cited

U.S. PATENT DOCUMENTS

| | | | | | |
|---|---|---|---|---|---|
| 1,173,843 | A | | 2/1916 | Morten | |
| D155,927 | S | * | 11/1949 | Rothkrug | D11/78.1 |
| 4,356,646 | A | | 11/1982 | Johnson, Jr. | |
| 5,249,437 | A | | 10/1993 | Cole, Jr. | |
| 5,520,230 | A | * | 5/1996 | Sumner, III | 150/147 |
| 5,592,767 | A | | 1/1997 | Treske | |

* cited by examiner

*Primary Examiner*—Jeffrey L. Gellner

(57) ABSTRACT

The combination money clip and card holder comprises a one-piece element having a rectangular base with two inwardly-oriented L-shaped brackets formed along longitudinal edges thereof. The rectangular base also contains a stop, formed on one of the transverse edges thereof. Together with the rectangular base, the L-shaped brackets comprise a channel for receiving flexible cards, such as credit cards, whereas the stop prevents the cards from being inserted too far into the channel. The edges of the base supporting the L-shaped brackets are tapered in the direction of the stop to provide means for removably capturing the cards inserted into the channel. The holder also includes a resilient money clip formed on the opposite side of the base. The money clip is formed so that it is biased toward the base, thus allowing bank notes inserted between the clip and the base to be removably retained therein.

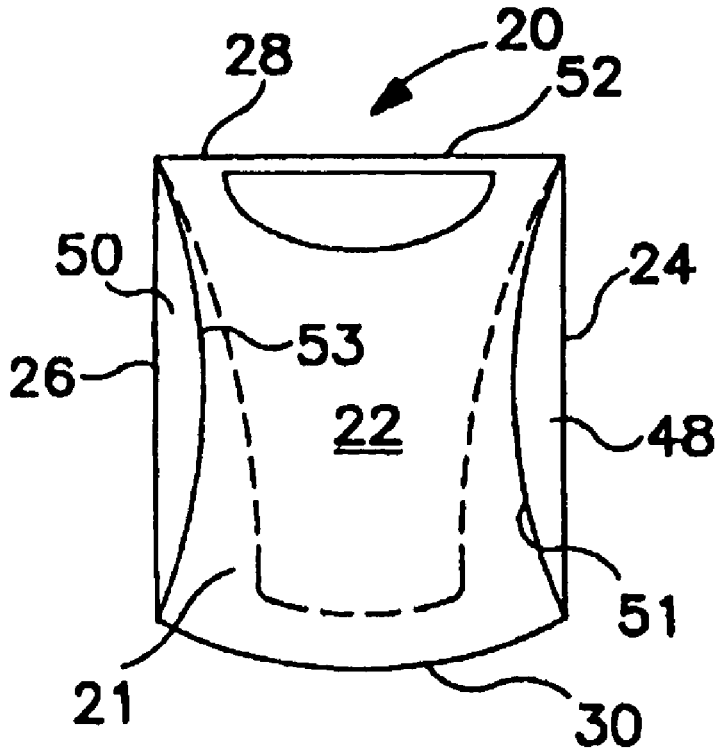

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 6, 7, and 14 is confirmed.

Claims 1–5, 8–13 and 15 are cancelled.

* * * * *